US006042291A

United States Patent [19]

Ho

[11] Patent Number: 6,042,291

[45] Date of Patent: Mar. 28, 2000

[54] DOCUMENT HOLDER WITH SLIDABLE CLASSIFYING RIDER

[76] Inventor: Chin-Lien Ho, No. 36, Lo-Yang Rd., Hsi-Tun Dist, Taichung, Taiwan

[21] Appl. No.: 09/209,954

[22] Filed: Dec. 11, 1998

[51] Int. Cl.[7] ..... B42D 3/10; B42D 17/00; B42D 9/00

[52] U.S. Cl. ..... 402/79; 281/21.1; 281/38; 281/45; 116/235; 116/236; 116/240; 116/321; 116/322; 116/323; 116/324; 116/327

[58] Field of Search ..... 281/38, 21.1, 45; 402/79; 116/235, 236, 240, 321, 322, 323, 324, 327

[56] References Cited

U.S. PATENT DOCUMENTS 3,719,161 3/1973 Wegner ..... 116/240
5,335,027 8/1994 Lin et al. ..... 281/45
5,865,469 2/1999 Chin ..... 281/21.1

*Primary Examiner*—Andrea L. Pitts
*Assistant Examiner*—Mark T. Henderson
*Attorney, Agent, or Firm*—Christie, Parker & Hale, LLP

[57] ABSTRACT

A document holder includes upper and lower plastic sheets superimposed on each other to define a document holding space therebetween. A saddle member of a flexible and heat sealable material is heat sealed on two corresponding edges of the upper and lower sheets to form a stiffened ridge, and first and second straddle portions that extend along an entire length of the stiffened ridge. A rider has a riding portion slidably disposed on the straddle portions and a tab index holding portion exposed outwardly of the stiffened ridge into which a tab index can be inserted to classify the documents held in the document holding space.

4 Claims, 6 Drawing Sheets

DOCUMENT HOLDER WITH SLIDABLE CLASSIFYING RIDER

BACKGROUND OF THE INVENTION

1. Field of the Invention

The invention relates to a document holder, more particularly to a document holder which has a rider slidably disposed along a lateral edge thereof. The rider is adapted to receive a tab index therein for classifying the documents held in the document holder.

2. Description of the Related Art

Referring to FIG. 1, a conventional document holder 10 is shown to include upper and lower sheets superimposed on each other and are made of a flexible and heat sealable material. Each of the upper and lower sheets has a left lateral edge, a right lateral edge spaced apart from the left lateral edge in a transverse direction, and front and rear edges spaced apart from each other in a longitudinal direction. The upper and lower sheets are heat sealed along three lateral edges 101 thereof so as to define an insert opening 11 for insertion of documents 12 into a document holding space formed between the upper and lower sheets. A tab index 13 can be stuck on one of the lateral edges 101 in order to identify the documents 12.

FIG. 2 shows another conventional document holder 20 which includes upper and lower flexible plastic sheets 23 which are heat sealed together along the left lateral edges and the rear edges thereof so as to define front and right insert openings. Note that one of the sheets 23 is provided with an outward extension 21 upon which a tab index 22 can be stuck thereto in order to identify the documents held between the upper and lower sheets 23.

Since the documents held in the aforesaid conventional document holders can change from time to time, the user has to update the corresponding tab index. Generally, a new tab index is adhesively mounted on the old tab index in order to correspond with the new documents held in the conventional document holder. As such, the thickness thereof will increase in long term use and will subsequently affect the appearance of the document holder.

SUMMARY OF THE INVENTION

Therefore, the object of this invention is to provide a document holder for holding sheets of paper therein and which is clear of the aforementioned drawbacks generally associated with the conventional document holders.

Accordingly, the document holder of this invention includes upper and lower sheets made of a flexible and heat sealable material, a saddle member and a rider. The upper and lower sheets are superimposed on each other to form a document holding space therebetween. Each of the upper and lower sheets has a left lateral edge, a right lateral edge spaced apart from the left lateral edge in a transverse direction, and front and rear edges spaced apart from each other in a longitudinal direction. A first one of the right lateral and front and rear edges of the upper sheet is connected to a corresponding first one of the edges of the lower sheet. A second one of the right lateral and front and rear edges of the upper sheet cooperates with a corresponding second one of the edges of the lower sheet to form an access opening into the document holding space. The saddle member is made of a flexible and heat sealable material, and is formed from an elongate sheet that is folded along a first line parallel to one of the transverse and longitudinal directions to form first and second straddle portions which are of a first length in the respective one of the transverse and longitudinal directions, and a first folded juncture interposed between the first and second straddle portions. A third one of the right lateral and front and rear edges of the upper sheet and a corresponding third one of the right lateral and front and rear edges of the lower sheet extend between the first and second straddle portions to engage the first folded juncture. The first folded juncture is heat sealed to the third one of the right lateral and front and rear edges of the upper and the corresponding third one of the right lateral and front and rear edges of the lower sheet along the first length to form the upper and lower sheets with a stiffened ridge. The rider is made of a flexible and heat sealable material, and is formed from a strip. The strip is folded along a middle line to form first and second leg portions which are of a second length shorter than the first length, a second folded juncture interposed between the first and second leg portions, and first and second middle portions disposed between the second folded juncture and a respective one of the first and second leg portions. The first and second middle portions are heat sealed to each other at a heat sealing seam along a second line parallel to the middle line so as to form a tab index holding portion between the second folded juncture and the heat sealing seam, and so that the first and second leg portions are straddled apart from each other in order to form a riding portion. Each of the first and second leg portions has a gliding end which is formed by folding a respective one of the first and second leg portions along a third line parallel to the second line toward the other one of the leg portions and toward the second folded juncture. The first and second leg portions straddle the saddle member with the gliding end of each of the first and second leg portions being retained slidably on a respective one of the first and second straddle portions to permit the riding portion of the rider to ride slidably on the saddle member.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
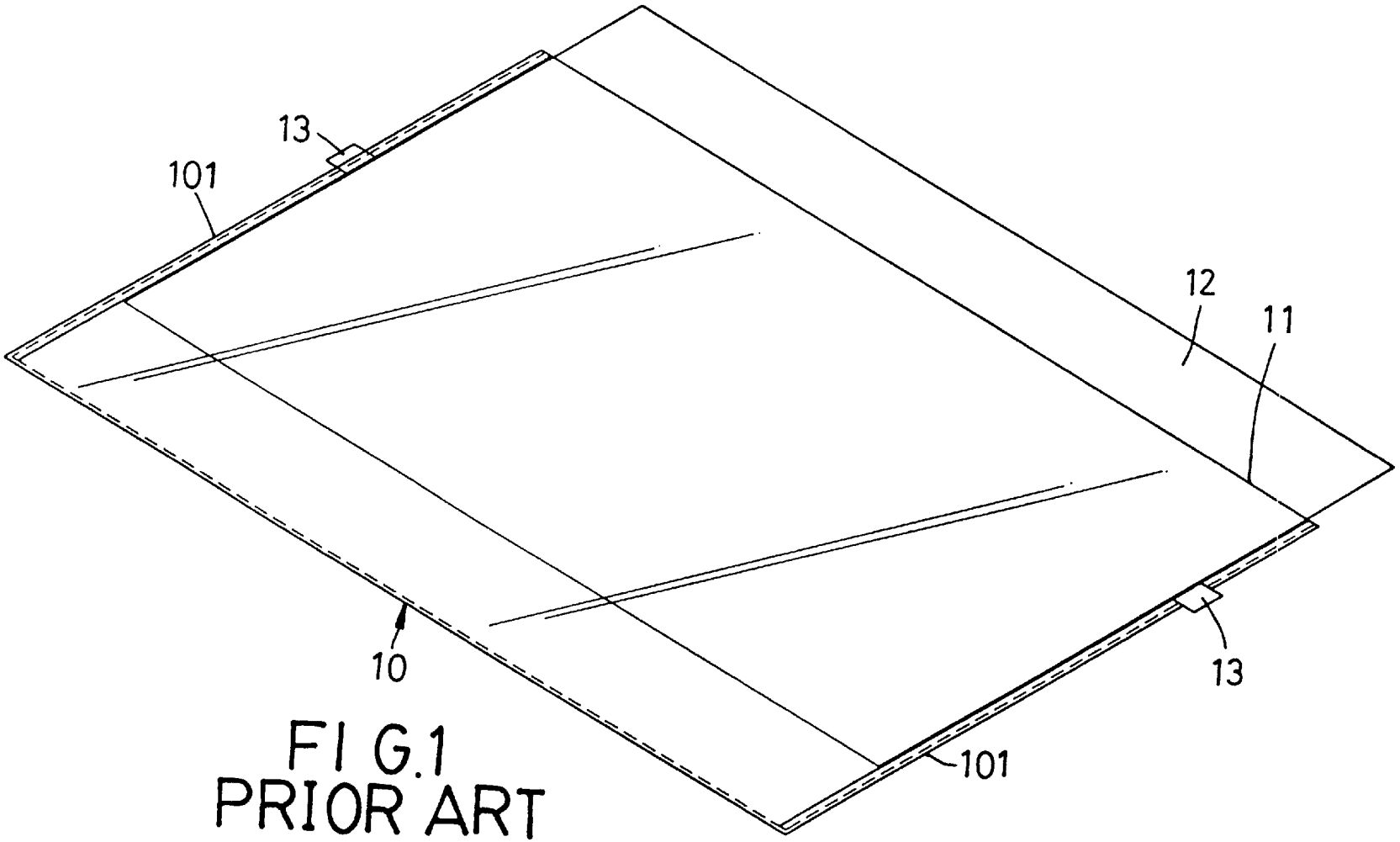
FIG.1 PRIOR ART
FIG. 1 is a perspective view of a conventional document holder provided with a tab index to classify the documents held therein.
Figure 2:
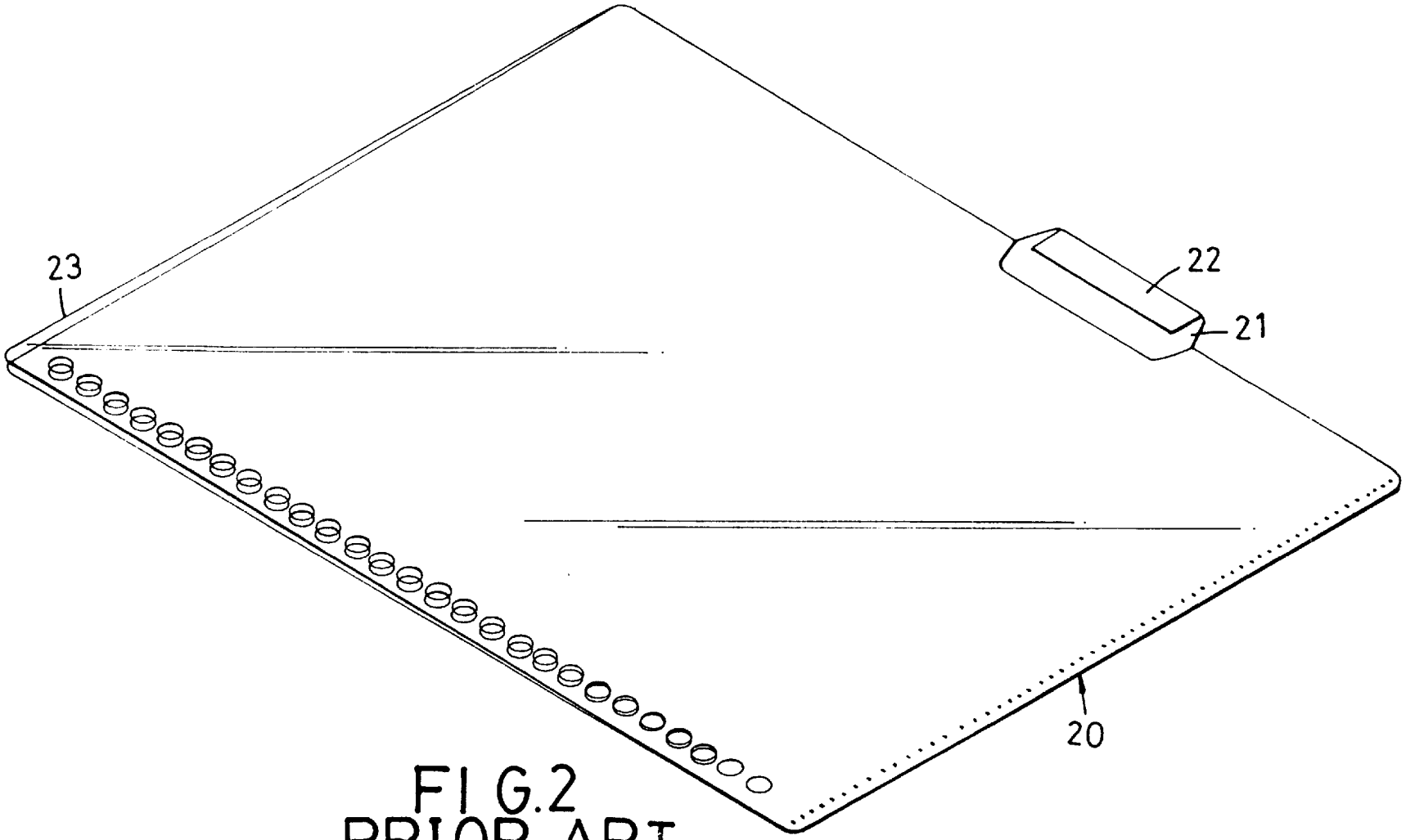
FIG. 2 PRIOR ART
FIG. 2 is a perspective view of another conventional document holder provided with a tab index to classify the documents held therein.
Figure 3:
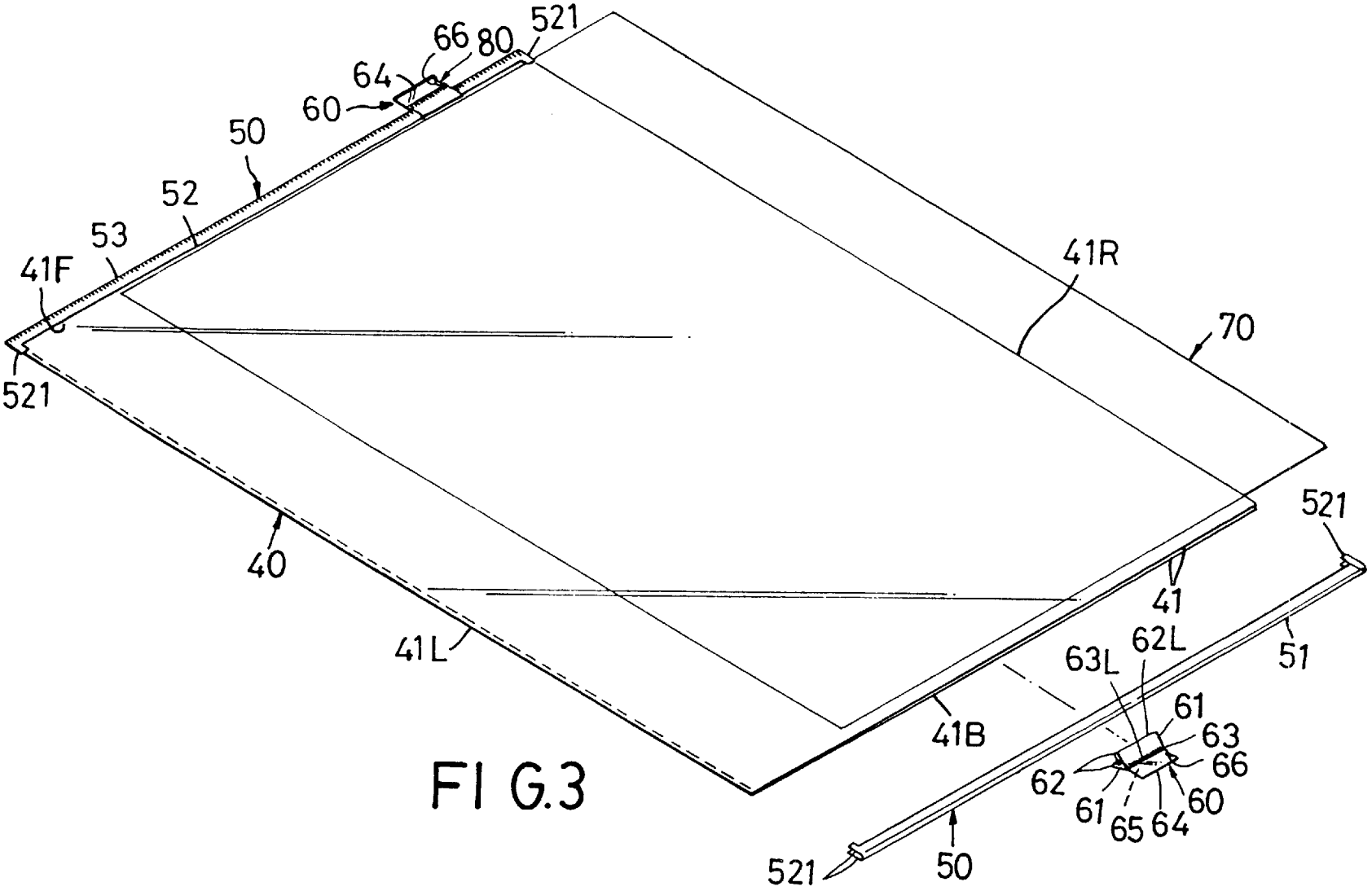
FIG. 3 is an exploded view of a preferred embodiment of a document holder of this invention.
Figure 4:
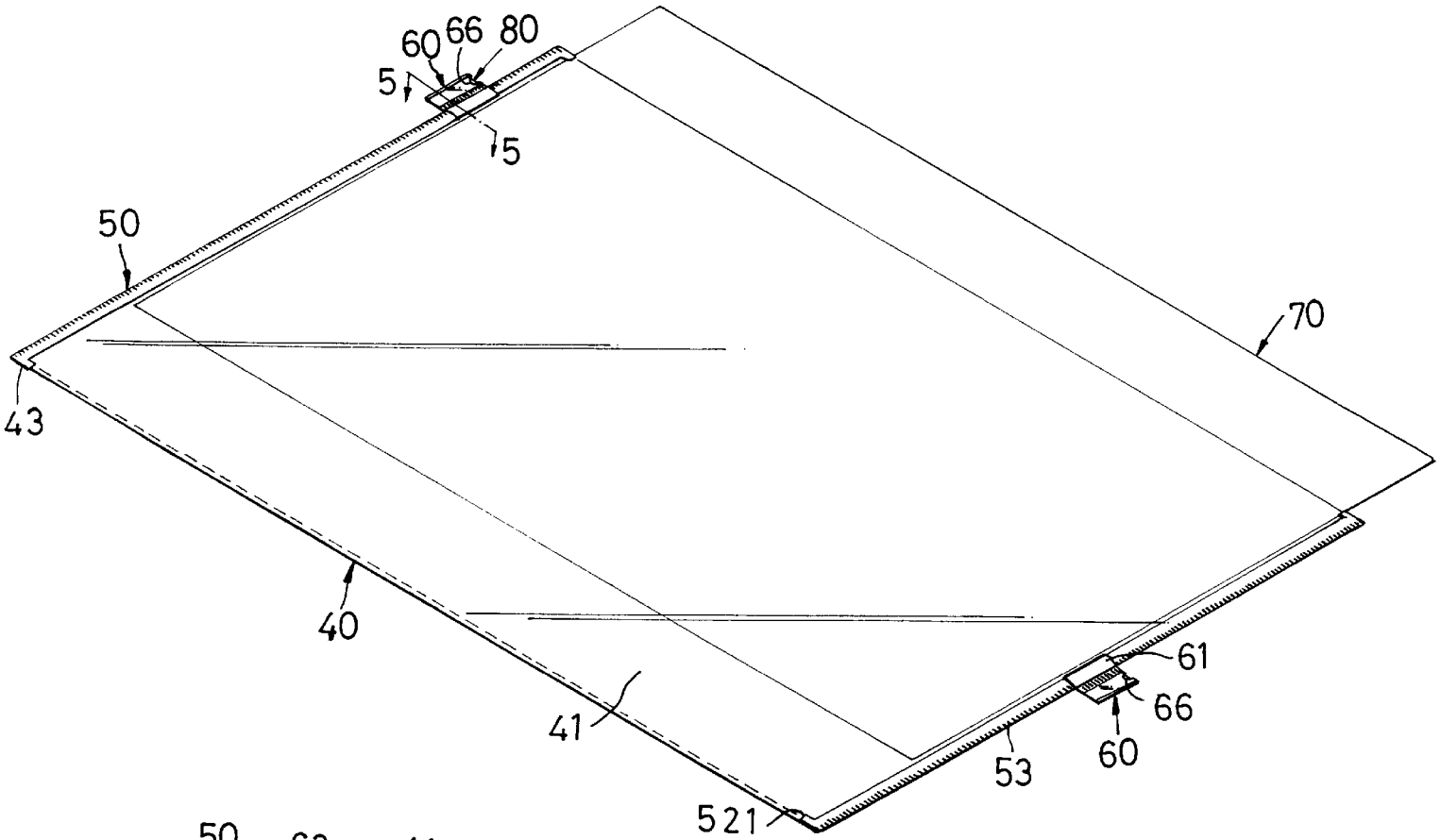
FIG. 4 is a perspective view of the preferred embodiment.
Figure 5:
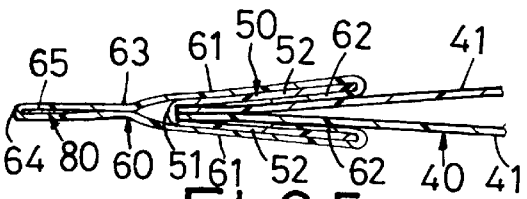
FIG. 5 is a sectional view of the preferred embodiment taken along line 5—5 in FIG. 4.

Referring to FIGS. 3, 4, and 5, the preferred embodiment of a document holder 40 of this invention is adapted to hold documents 70 therein, and includes upper and lower sheets 41, a saddle member 50, and a rider 60.

As illustrated, the upper and lower sheets 41 are made of a flexible and heat sealable material, and are superimposed on each other to form a document holding space therebetween. Each of the upper and lower sheets 41 has a left lateral edge 41L, a right lateral edge 41R spaced apart from the left lateral edge 41L in a transverse direction, and front and rear edges 41F, 41B spaced apart from each other in a longitudinal direction. A first one of the right lateral and front and rear edges 41R, 41F, 41B of the upper sheet 41 is connected to a corresponding first one of the edges 41R, 41F, 41B of the lower sheet 41. A second one of the right lateral and front and rear edges 41R, 41F, 41B of the upper sheet 41 cooperates with a corresponding second one of the edges 41R, 41F, 41B of the lower sheet 41 to form an access opening into the document holding space.

The saddle member 50 is made of a flexible and heat sealable material, and is formed from an elongate sheet that is folded along a first line parallel to a respective one of the transverse and longitudinal directions to form first and second straddle portions 52 which are of a first length in the respective one of the transverse and longitudinal directions, and a first folded juncture 51 interposed between the first and second straddle portions 52. A third one of the right lateral and front and rear edges 41R, 41F, 41B of the upper sheet 41 and a corresponding third one of the right lateral and front and rear edges 41R, 41F, 41B of the lower sheet 41 extend between the first and second straddle portions 52 to engage the first folded juncture 51. The first folded juncture 51 of the saddle member 50 is heat sealed to the third one of the right lateral and front and rear edges 41R, 41F, 41B of the upper sheet 41 and the corresponding third one of the right lateral and front and rear edges 41R, 41F, 41B of the lower sheet 41 along the first length such that the upper and lower sheets 41 are formed with a stiffened ridge 53.

The rider 60 is made of a flexible and heat sealable material, and is formed from a plastic strip. The strip is folded along a middle line to form first and second leg portions 61 which are of a second length shorter than the first length, a second folded juncture 64 interposed between the first and second leg portions 61, and first and second middle portions 63 disposed between the second folded juncture 64 and a respective one of the first and second leg portions 61. The first and second leg portions 61 are heat sealed to each other at a heat sealing seam 63L along a second line parallel to the middle line so as to form a tab index holding portion 65 that is disposed between the second folded juncture 64 and the heat sealing seam 63L, and so that the first and second leg portions 61 are straddled apart from each other in order to form a riding portion. Each of the first and second leg portions 61 further has a riding portion 62 which is formed by folding the same along a third line 62L parallel to the second line toward the other one of the first and second leg portions 61 and toward the second folded juncture 64. The first and second leg portions 61 straddle the saddle member 50 with the riding portion 62 of each of the first and second leg portions 61 are retained slidably on a respective one of the first and second straddle portions 52 so as to permit the riding portion 62 of the rider 60 to ride slidably on the saddle member 50.

In the preferred embodiment, each of the first and second straddle portions 52 is further provided with a pair of stop units 521 mounted on opposite ends thereof to limit the sliding movement of the rider 60 along the saddle member 50. The tab index holding portion 65 has one end portion formed with an insert opening that is adapted for inserting a tab index 80 (see FIGS. 4 and 5) thereinto, a periphery that confines the insert opening, and a peripheral notch 66 formed in the periphery to facilitate insertion and removal of the tab index 80.

Figure 6:
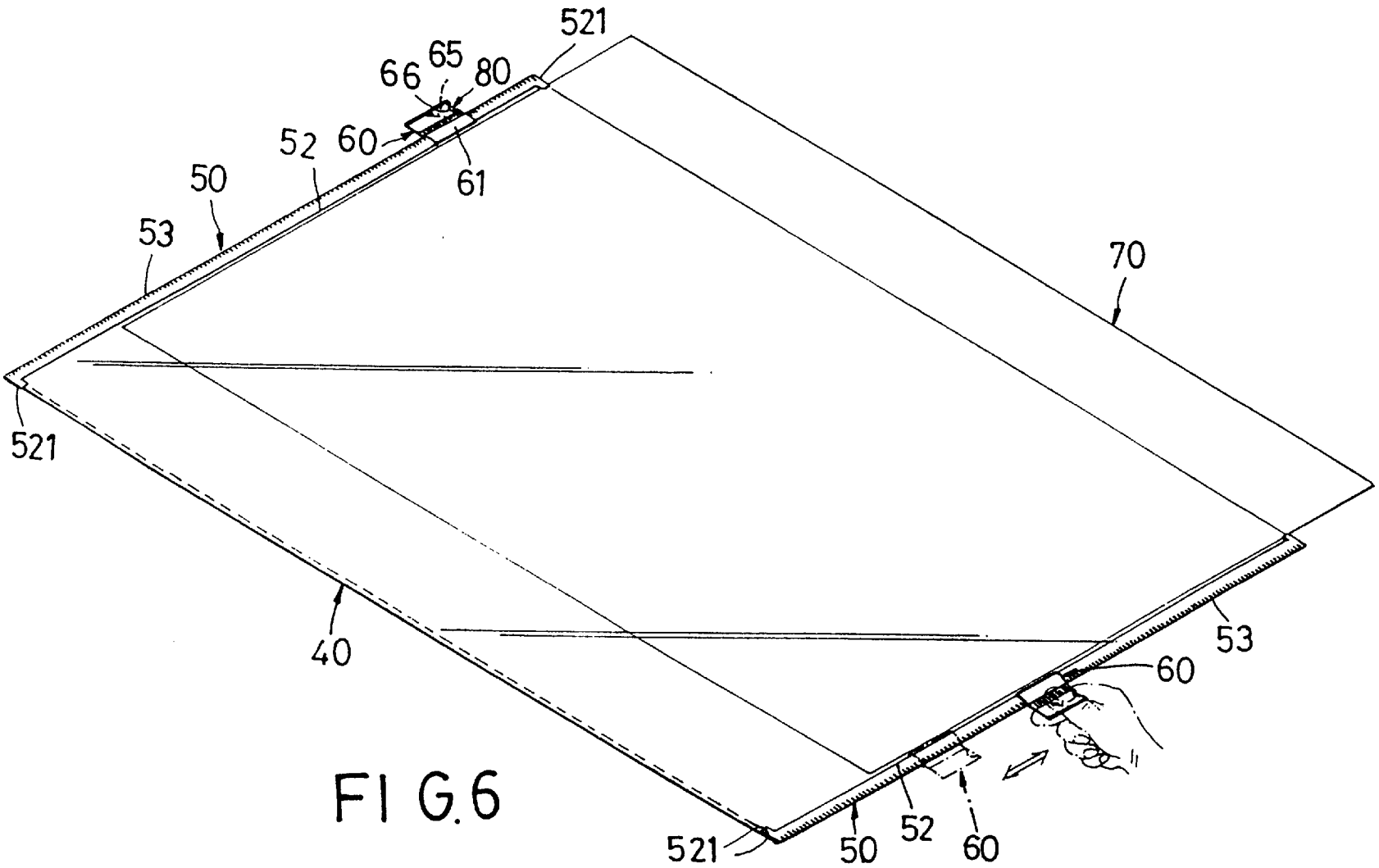
FIG. 6 illustrates how a rider is mounted slidably along lateral edges of upper and lower sheets in order to classify the documents held in the document holder.
Figure 7:
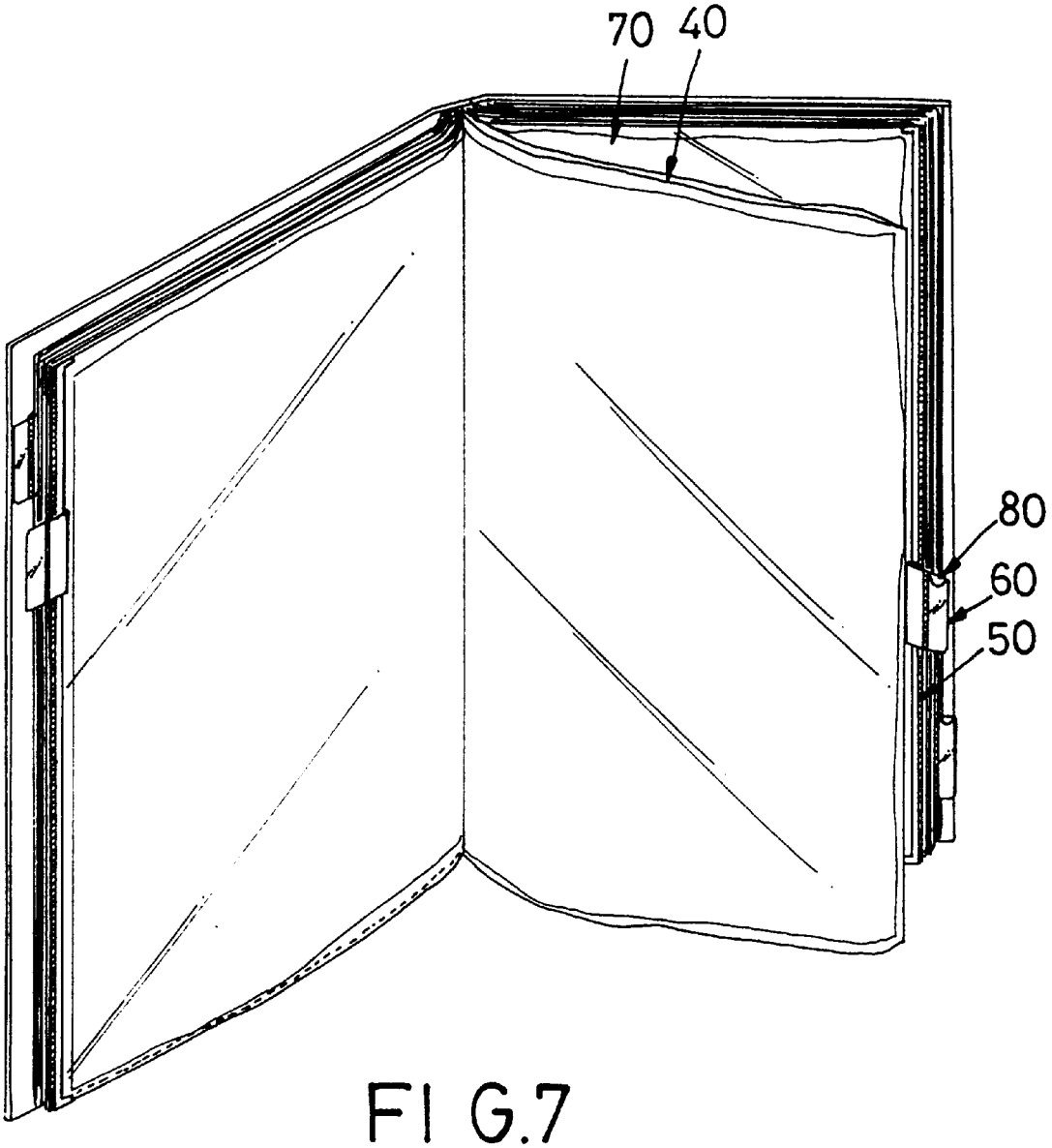
FIG. 7 illustrates how a plurality of the document holders of this invention are bound in a loose-leaf binder.

FIG. 6 illustrates how the rider 60 is moved from one position to another. FIG. 7 illustrates how the left lateral edges of the upper and lower sheets 41 of a plurality of document holders according to this invention are bound in a loose-leaf binder.

The advantages that result from the use of the preferred embodiment are as follows:

Since the tab index 80 is inserted into the tab index holding portion 65, removal or replacement of a new tab index 80 is convenient to conduct.

The rider 60 can be moved relative to the saddle member 50 so that when a plurality of the document holders of this invention are bound by a loose-leaf binder, the riders 60 can be disposed staggered relative to one another so as to facilitate locating an appropriate document.

When desired, the discarded document holders need not be dismantled, and can be directly recycled.

With this invention thus explained, it is apparent that numerous modifications and variations can be made without departing from the scope and spirit of this invention. It is therefore intended that this invention be limited only as indicated in the appended claims.

I claim:

1. A document holder comprising:

upper and lower sheets made of a flexible and heat sealable material and superimposed on each other to form a document holding space therebetween, each of said upper and lower sheets having a left lateral edge, a right lateral edge spaced apart from said left lateral edge in a transverse direction, and front and rear edges spaced apart from each other in a longitudinal direction, a first one of said right lateral and front and rear edges of said upper sheet being connected to a corresponding first one of said edges of said lower sheet, a second one of said right lateral and front and rear edges of said upper sheet cooperating with a corresponding second one of said edges of said lower sheet to form an access opening into said document holding space;

a saddle member made of a flexible and heat sealable material, and formed from an elongated sheet that is folded along a first line parallel to one of said transverse and longitudinal directions to form first and second straddle portions which are of a first length in said one of said transverse and longitudinal directions, and a first folded juncture interposed between said first and second straddle portions, a third one of said right lateral and front and rear edges of said upper sheet and a corresponding third one of said right lateral and front and rear edges of said lower sheet extending between said first and second straddle portions to engage said first folded juncture, said first folded juncture being heat sealed to said third one of said right lateral and front and rear edges of said upper sheet and said corresponding third one of said edges of said lower sheet along said first length to form said upper and lower sheets with a stiffened ridge; and a rider made of flexible and heat sealable material, and formed from a strip that is folded along a middle line to form first and second leg portions which are of a second length shorter than said first length, a second folded juncture interposed between said first and second leg portions, and first and second middle portions disposed between said second folded juncture and a respective one of said first and second leg portions, said first and second middle portions being heat sealed to each other at a heat sealing seam along a second line parallel to said middle line so as to form a tab index holding portion between said second folded juncture and said heat sealing seam, and so that said first and second leg portions are straddled apart from each other in order to form a riding portion, each of said first and second leg portions having a gliding end formed by folding each of said first and second leg portions along a third line parallel to said second line toward the other one of said first and second leg portions and toward said second folded juncture, said first and second leg portions straddling said saddle member with said gliding end of each of said first and second leg portions being slidably retained on a respective one of said first and second straddle portions to permit said riding portion of said rider to ride slidably on said saddle member.

2. The document holder as defined in claim 1, wherein each of said first and second straddle portions is provided with a pair of stop units on opposite ends thereof to limit sliding movement of said rider along said saddle member.

3. The document holder as defined in claim 1, wherein said tab index holding portion has one end portion formed with an insert opening adapted for inserting a tab index into said tab index holding portion, a periphery confining said insert opening, and a notch formed in said periphery.

4. The document holder as defined in claim 1, wherein said left lateral edges of said upper and lower sheets are adapted to be bound in a loose-leaf binder.

* * * * *